United States Patent [19]

Kleinwächter et al.

[11] Patent Number: 4,631,922

[45] Date of Patent: Dec. 30, 1986

[54] HEAT ENGINE

[75] Inventors: Jürgen Kleinwächter, Kandern; Hans Kleinwächter, Lörrach; Otto Klaas, Mühlheim, all of Fed. Rep. of Germany

[73] Assignee: Bomin Solar GmbH & Co. KG, Lörrach, Fed. Rep. of Germany

[21] Appl. No.: 818,428

[22] Filed: Jan. 13, 1986

[30] Foreign Application Priority Data

Jan. 25, 1985 [DE] Fed. Rep. of Germany ..... 3502363
Mar. 12, 1985 [DE] Fed. Rep. of Germany ..... 3508689

[51] Int. Cl.[4] ..... F02G 1/04
[52] U.S. Cl. ..... 60/518; 60/520
[58] Field of Search ..... 60/518, 520

[56] References Cited

U.S. PATENT DOCUMENTS

Re. 30,176 12/1979 Beale ..... 60/520
3,991,586 11/1976 Accord ..... 60/520 X
4,188,791 2/1980 Mulder ..... 60/520

*Primary Examiner*—Allen M. Ostrager
*Attorney, Agent, or Firm*—Browdy and Neimark

[57] ABSTRACT

In the case of a heat engine, in particular a Stirling engine, comprising a displacement piston and a working piston which are coupled together in a housing sealed in a leak-proof manner against the outside so that they can oscillate in a linear direction, in which case the gas space between the displacement piston and the working piston is connected to the gas space between the displacement piston and the housing by way of a heater, a cooler and a regenerator arrangement to which an external source of heat may be connected, in order to make possible the take-off of mechanical energy from the closed housing for external use, provision is made for one magnetic or magnetizable coupling device (9, 15) located within the housing (1) to be connected at least with the working piston (2) and there is also a corresponding magnetic or magnetizable coupling device (8, 18) outside the housing (1) which is movably mounted in parallel with the piston travel.

13 Claims, 6 Drawing Figures

HEAT ENGINE

FIELD OF THE INVENTION

The present invention relates to a heat engine, in particular a Stirling engine, comprising a displacement piston and a working piston which are coupled together in a housing sealed in a leak-proof manner against the outside so that they can oscillate in a linear direction, in which case the gas space between the displacement piston and the working piston is connected to the gas space between the displacement piston and the housing by way of a heater, a cooler and a regenerator arrangement to which an external source of heat may be connected.

BACKGROUND OF THE INVENTION

Such types of externally-heated, regenerative heat engines possess good prospects for wider utilization in the future because of their low emission of exhaust gases, their very high attainable efficiency and their adaptability to the most diverse sources of energy supply. An example of this type of heat engine is the Stirling engine.

Although heat engines of this type operate according to an inherently ideal, reversible cycle, which evolves between two isotherms and two isochores, and therefore have a fundamentally higher Carnot cycle efficiency than do the much more widely-used internal combustion engines, up till the present time they have not been able to establish themselves on a widespread basis for several different reasons.

A problem resides in the face that, in order to achieve a high degree of efficiency, the temperature of the heater head must be very high and it is only in the most recent times that suitable materials have been developed for this purpose. A further fundamental problem arises from the fact that, for achieving a good power density associated with an appropriately small compact engine, the engine must be filled with helium or hydrogen under high pressure. This leads, for example in the known crankshaft Stirling engines, to very considerable difficulties because, on the one hand, the sealing of the crankshaft is supposed to avoid the loss by leakage of the working gas and, on the other hand, to prevent the ingress of oil and lubricants from the gearbox into the interior of the engine. An improvement for the solution of this problem was presented by the invention of the free-piston Stirling engine (U.S. Pat. No. Re. 30,176).

This type of arrangement does not require a crankshaft because not only the working piston, but also the displacement piston, supported freely and resiliently by gas or mechanical means, undergoes linear oscillatory motion within an hermetically-sealed pressure housing. This gives rise to a mass-spring resonance system which is, or should be, tuned by selection of the magnitudes of the spring constants, mass- and flow-cross-sections, in such a manner that as close an approach as possible is made to the movement kinematics of the ideal Stirling cycle.

With the use of such a free-piston engine, in contrast to the construction employing a crankshaft, the advantage is obtained that it is completely gas-tight and therefore no diffusion of gas can take place from the inside to the outside of the engine and there can be no penetration of oil from the outside into the engine. In addition to this, the construction, at least as far as the elementary components are concerned, is uncomplicated and makes a relatively long working life a distinct possibility. The end result is that an increased degree of efficiency may be attained, because there are no losses due to the crankshaft operation.

However, there are problems involved in the practical utilization of such a type of engine. Because all the mechanical movements take place only in the interior of the engine and there is no mechanical connection with the outside whatsoever, it is necessary to employ additional auxiliary devices, even within the engine itself, for the transformation of the oscillatory movement of the working piston into useful thermal or electrical energy. This leads to the situation where, for example, in contrast to the use of conventional, commercially-available, rotating generators for the production of electrical current, use must be made of relatively-expensive linear generators.

Even greater problems arise if it is desired to derive mechanical energy as such from the engine. To this end, experiments have been conducted in an attempt to transfer the periodic pressure fluctuations within the engine to an hydraulic system by way of a membrane. Another attempt at a solution consists of constructing the working piston with a great enough weight so that the energy of its linear oscillation can be exploited by way of the related movement of the housing which results from the engine being mounted on a flexible bearing. Both of these attempts at solution of the problem lead, in actual practice, to very considerable technical complications. There is, for example, the problem of what type of material to use for the membrane, and also the difficulties which arise in the transformation of the linear oscillatory motion of the engine housing into a rotary movement.

An additional fundamental problem with free-piston machines is seen in the fact that it is extraordinarily difficult to deal analytically with such a mass-spring resonance system. In this regard, it is especially the question of centering the piston around the middle position, as well as the phase angle between the displacement- and working-piston, which causes the difficulty. For conversion from the theoretical considerations, measures such as the provision of by-pass channels for the gas, intermediate storage for the gas, spring for mechanical centering, and the like, were adopted. All of these measures reduce the ideal efficiency and only operate over severly-limited ranges, thus leading to deviations from the ideal Stirling cycle.

SUMMARY OF THE INVENTION

On the basis of the foregoing considerations, the problem to be solved by the present invention is the provision of an externally-heated, regenerative, heat engine which combines the advantages of the free-piston- and the crankshaft-engines, while avoiding, as far as possible, the disadvantages currently associated with both of them.

In addition to this, the invention should be able to provide the simple possibility of external mechanical coupling of the energy developed by an engine of the type which is under consideration here.

The solution to this problem is to be found in that one magnetic or magnetizable coupling device located within the housing is connected at least with the working piston and there is also a corresponding magnetic or magnetizable coupling device outside the housing which is movably mounted to coincide with the piston travel. By means of the magnetic external coupling of the mechanical energy derived from the linearly-oscillating working-piston, it is possible to obtain the optimal configuration for a free-piston engine, without the need for taking any specific precautions regarding the construction, such as the type of mounting and the nature of the materials employed. The magnetically coupled motion may be transferred externally to all the known types of mechanical power-transfer- and -conversion-systems of any arbitrary aggregate of secondary equipment as desired. In so far as such types of secondary- or sub-aggregates of equipment do not require rotational movement, but only make use of linear motions, the vibrational energy can be used with direct external coupling. The magnetic coupling offers the additional advantage that it can act as a slip clutch in the case of overloading.

A particularly simple form of embodiment of the solution in accordance with the invention is presented in that the coupling device within the housing comprises a soft-iron ring and the coupling device outside the housing is formed from at least one magnet. The magnets which, according to this, are located outside the housing may be configured as permanent magnets or else as electromagnets. Under such conditions it is not necessary to have conductors of electricity within the housing for the electromagnets, because only soft-iron components are present there.

By providing that the coupling device within the housing possesses annular grooves open towards the outside, and the coupling device outside the housing possesses annular grooves open towards the inside, a dynamic vibration effect may be exerted on the piston for achieving an additional sealing.

For the coordination of the phase relations of the working- and displacement-pistons it is advantageous that not only the working piston but also the displacement piston is provided with a coupling device within the housing whereas the corresponding coupling devices outside the housing are connected together by way of a device which determines their mutual phase relation. This device for the coordination of the phase relations of the working- and displacement-pistons is preferably configured as a mechanical drive, in particular a crankshaft drive.

This configuration makes it possible for the inner sequence of movements of the working- and displacement-pistons not needing to be established as freely vibrating, but set up in a defined manner in accordance with desired kinematics, that is to say, corresponding to the selected, regenerative, externally-heated, thermodynamic cycle. In addition, the objective is achieved with such an arrangement that the problems associated with a free transient build-up, for example in relation to the centering, to the overswing behavior under alternating load conditions and to other difficulties which are associated with the kinematics of the free-piston engine, may be avoided. This leads to a considerable simplification of the free-piston component, with the avoidance of the need for the traditional active and passive control systems. For the realization of the invention, recourse may be had to already fully-developed mechanical phase-coupling techniques, so that it is possible, without any problems, to fabricate such types of engines in quite-widely differing performance classes on the basis of a fundamental elementary type.

Thus, in accordance with the invention, the magnetic coupling devices and the subsequent mechanical drive are utilized on the one hand, to yield the optimal output of the mechanical energy for further exploitation and, on the other hand, to impose a precisely defined predetermined phase relation, and a correspondingly coordinated vibration behavior, on the oscillating piston by way of a mechanical drive. In this way, the difficulties associated with conventional free-piston engines which made their appearance in the starting-up phase and under changing loads, are avoided.

In this manner all of the advantages of the free piston engine are attained, on the one hand, by the avoidance of the fundamental leak-proofing sealing problems and, on the other hand, the typical problems associated with free-piston engines, which arise from the complicated behavior of a freely oscillating system, are overcome without difficulty.

The provision of a transmission device engaging with at least one piston for the transmission of a rotary movement around their longitudinal axis to the pistons which is derived from the inherently linear movement of the pistons makes it possible to impose on this said device a rotary movement, about its longitudinal axis, which is derived from the linear movement of the displacement- and/or working-piston. Such a type of rotary movement, in combination with the previously-described magnetic coupling device on the outside of the engine housing, makes it possible to utilize a combined translatory and rotary movement, or a purely rotary movement, for driving aggregates of secondary equipment. At the same time, because of the rotary movement, there is a dynamic sealing effect created between the piston and the inner wall of the engine housing.

The measure of providing a non-rotatably but axially movable connection between the pistons ensures that the displacement piston and the working piston rotate in unison with each other but that they perform independent linear movements.

By providing that the transmission device consists of a mechanical or magnetic first coupling means located on the wall of the housing and a corresponding second coupling means connected to the piston(s), in which case the first and/or the second coupling means has/have a sine-shaped or cosine-shaped configuration, it is made possible, in a particularly simple manner, to transform the translatory movement of the piston into a rotary movement.

By arranging that the displacement piston has coupling means with a sine-shaped configuration and the working piston in relation thereto has coupling means with a cosine-shaped configuration, the effect is achieved that these coupling means can also, at the same time, be employed for producing a defined phase relation between working- and displacement-pistons in a similar fashion to that wherein not only the working piston bus also the displacement piston is provided with a coupling device within the housing whereas the corresponding coupling devices outside the housing are connected together by way of a device which determines their mutual phase relation. Under these conditions, with the establishment of an exact sine-cosine relationship between the coupling means which, on the one hand, are allocated to the working piston and, on the other hand, to the displacement piston, a phase difference of 90°, corresponding to the conventional phase difference, is established.

Instead of making provision for a fixed phase relation, the coupling means in accordance with the invention makes it possible for the phase relation to be adjustable, that is to say, by the alteration of the angle relation of the coupling means. For example, by way of magnetic manipulators, the phase relation between working- and displacement-piston may be altered for better adaptation to specified operating methods or operating conditions.

A particularly simple configuration of the coupling means consists in that the sine-shaped and cosine-shaped coupling means are formed by a groove and the associated coupling means are formed by roller cams which engage in the said grooves. Under these conditions, the cams which are specified there can equally well be configured as sliding cams, and provision can also be made for a wheel or roller to travel on the curved guideway in order to reduce the friction. Another configuration of the coupling means may consist in that the sine-shaped and the cosine-shaped coupling means are formed by a magnetic or magnetizable material which follows a sine-shaped or a cosine-shaped pathway around a piston or around the wall of the housing.

Corresponding to the sine- or cosine-shaped course of magnetizable or magnetic material, provision is made for a magnetic or magnetizable coupling means, corresponding to a cam, to interact with it.

DESCRIPTION OF THE PREFERRED EMBODIMENTS

Figure 1A:
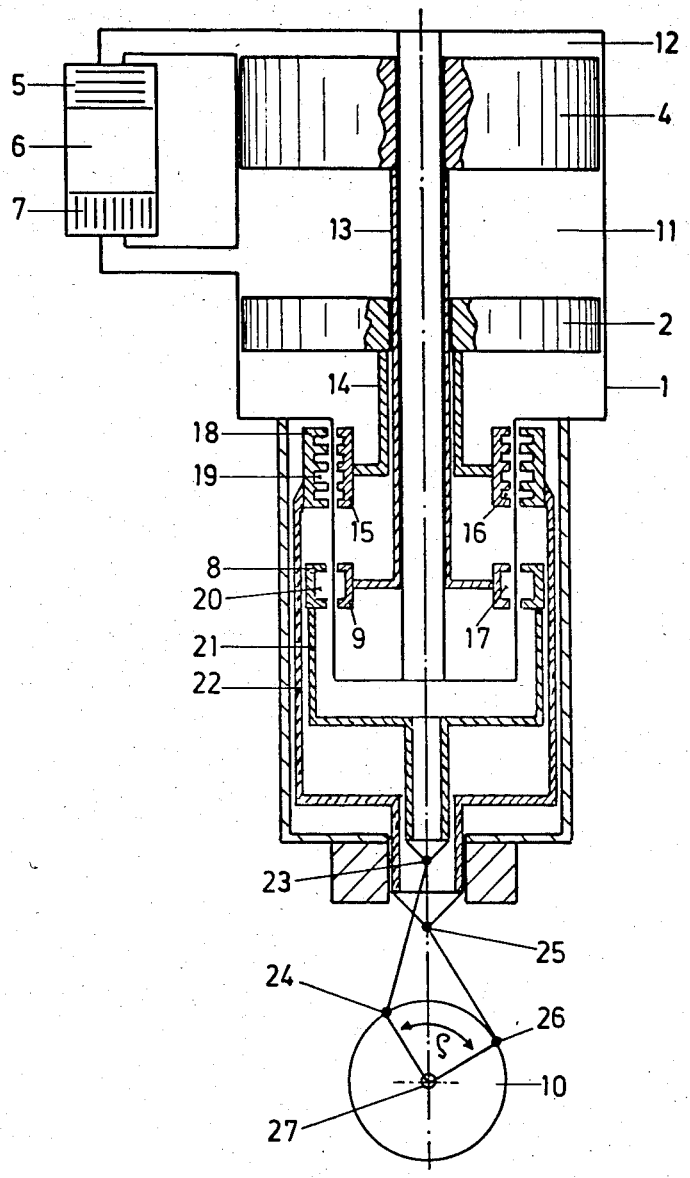
Figure 1B:
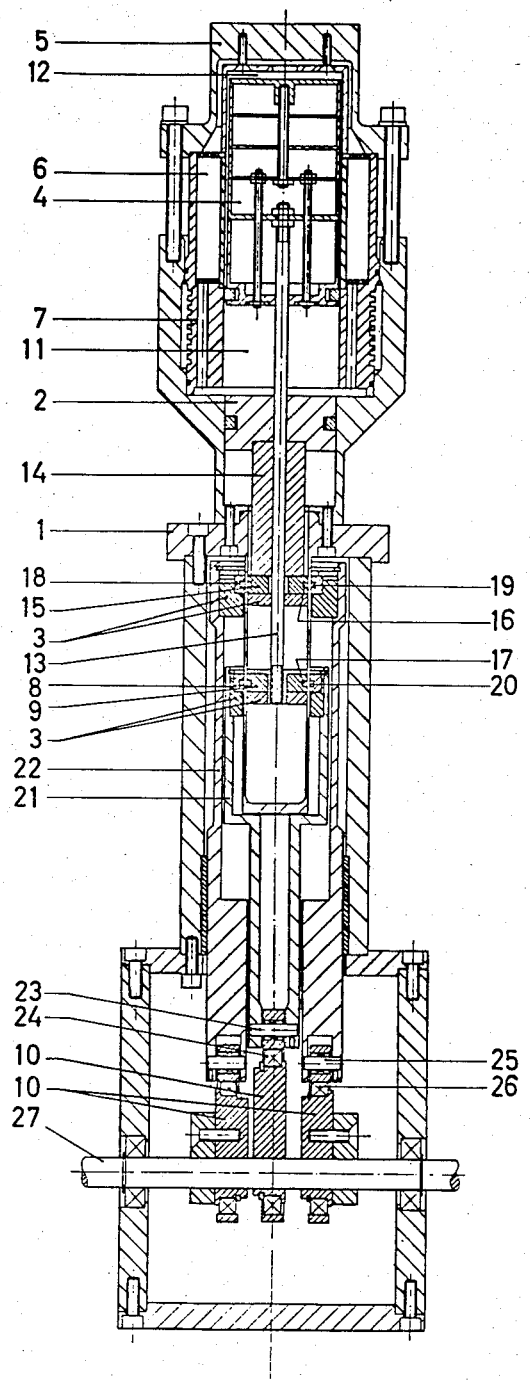

Further features, advantages and details of the invention are set out in the following description of a preferred form of embodiment, with reference to the drawings. There is depicted in FIG. 1*a* a diagrammatic section through a free-piston engine in accordance with the invention which operates on the Stirling principle, having a magnetic coupling device followed by a mechanical drive for illustration of the principle, FIG. 1*b* a section through a practically realized embodiment according to FIG. 1*a*, FIG. 2 a diagrammatic section presenting a view of the way in which the force-transmission components are developed, FIG. 3 a diagrammatic longitudinal section through a form of embodiment with coupling means for producing a rotary movement of the pistons, FIG. 4 a cross-section along the line IV—IV in FIG. 3 and FIG. 5 a representation of a form of embodiment corresponding to FIG. 4, with mechanical coupling means.

FIG. 1 shows a housing 1 which is fabricated as a pressure cylinder. Located within this housing 1 there is a working piston 2 which is slidably mounted by guide rings 3 so that it can move up and down in a linear direction. In addition to this, there is also a displacement piston 4 located within the housing 1 and this likewise is slidably mounted on the guide rings 3. A heater 5, a regenerator 6 and a cooler 7 are arranged in such a fashion that they connect an internal space 12, which is enclosed between the housing 1 and the displacement piston 4, with an internal space 11 which is enclosed between the displacement piston 4, the working piston 2 and the housing 1. The heater 5 is connected to an external source of heat, but this is not illustrated in the drawing.

The displacement piston 4 is connected to a first internal coupling device 9 by way of a linkage 13, whereas the working piston 2 is connected to a second internal coupling device 15 by way of a linkage 14. Both the coupling devices 9, 15 are fabricated as soft-iron rings which have annular grooves 16 and 17 respectively facing radially outwards.

The housing 1, or at least the region of the housing around the coupling devices 9, 15 is fabricated from a non-magnetic material. For this purpose it is possible to use, for example, a synthetic material, or else a non-magnetic metal such as aluminum, for example. In this last-named case there are only certain eddy-current losses which must be accepted as part of the bargain in the coupling process.

There are corresponding coupling devices 8, 18 located on the outside of the housing 1 at the same height as the internal coupling devices 9, 15 respectively. These external coupling devices are each formed as annular permanent magnets which have open annular grooves 19, 20 respectively which face radially inwards. Instead of the permanent magnets which are depicted here for the sake of simplicity, it is also possible to use correspondingly configured electromagnets, in which case the said electromagnets may be supplied with either direct current or alternating current.

The external coupling devices 8, 18 are connected together by means of the linkages 21 and 22 respectively, in which case the two linkages 21 and 22 are movably mounted to be independent of one another in the axial direction. The linkage 21 is connected to a mechanical drive 10 with a crankshaft configuration by way of the articulated joints 23, 24 and the linkage 22 is connected by way of the articulation joints 25, 26 to the same drive. The mechanical drive 10, which is known as such from conventional Stirling engines, is represented only diagrammatically in FIG. 1. By way of the selection of the angle relation of the articulation joints 24, 26 the phase angle between working piston 2 and displacement piston 4 is predetermined. Based upon the coupling between drive 10 and the working piston 2 as well as the displacement piston 4, there is an ensured fixed phase relation between working piston 2 and displacement piston 4 not only when starting-up but also with the occurrence of load fluctuations.

For achieving an optimal degree of operational efficiency, the pistons 2, 4 and the gas channels as well as the gas spaces are dimensioned in such a manner that, in the case of an ideal free oscillation, a phase angle $\phi$, of 90° for example, would be established as provided for by means of the mechanical drive 10. This allows for the attainment of a particularly favorable operational efficiency because the drive 10 then only has a retroactive effect on the phase relation between working piston 2 and displacement piston 4 in the critical regions. At the same time, the drive shaft 27 of the mechanical drive 10 serves for the actuation of subsequently couple equipment aggregates, so that a very favorable exploitation of the mechanical energy derived from the working piston 2 and the displacement piston 4 is rendered possible.

Figure 2:
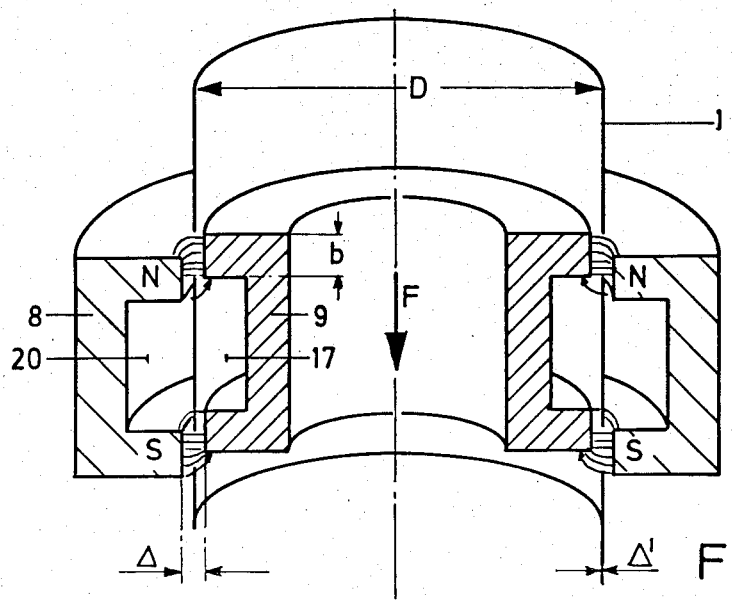

In FIG. 2 there is a representation of how an axial force component F, shown by the arrow, and representing the coupling force being striven for, is developed on the basis of the geometry of the internal and external coupling devices 8 and 9 which have open annular grooves 20 and 17 respectively, facing towards each other, when the said devices undergo axial movement in relation to one another.

If eddy-current losses are neglected, in the situation where only that part of the housing 1 which encloses the cold portion of the engine is fabricated from an insulating synthetic material, then a coupling force of approximately 800 Newton is developed if there is the fundamental provision of an air-gap induction of 0.5 Tesla with a piston diameter of 25 cm and an air-gap of 1 cm. Computational treatment of eddy-current losses when a conducting housing 1, for example of aluminum, is employed, shows that the losses to be taken into consideration are only of negligible magnitude. Also special steels can be used.

Figure 3:
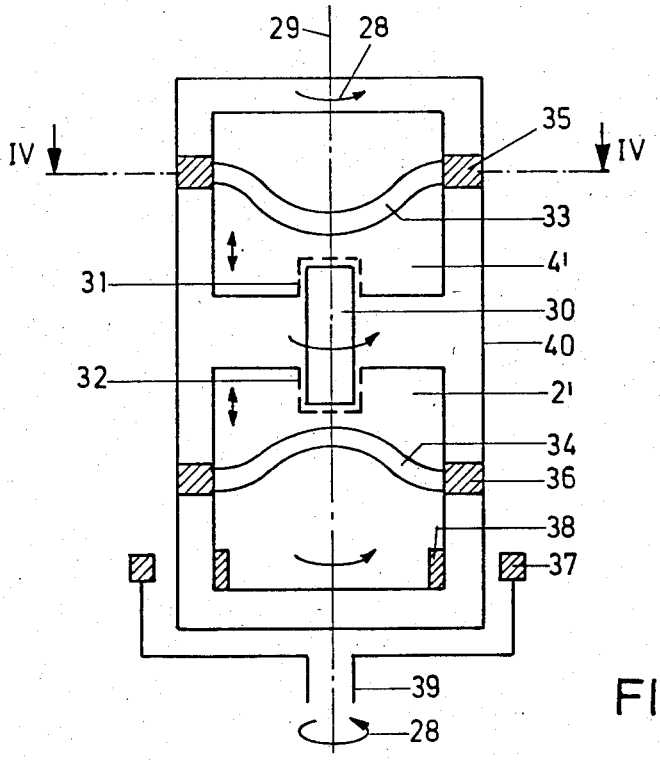

FIG. 3 depicts a form of embodiment in which a rotary movement (arrow 28) around the common longitudinal axis 29, which is derived from the oscillatory translatory movement of the working piston 2' and the displacement piston 4', which are only diagrammatically represented in the drawing, is imposed upon these said pistons. The diagrammatic representation in FIG. 3 is limited to the elucidation of the derivation of this rotary movement from the oscillatory movement along the axis 29.

In order to arrive at the situation where the working piston 2' and the displacement piston 4' rotate simultaneously and to the same extent around the axis, a connection 30 is provided in the form of an arbor which engages in recesses 31 and 32 in the displacement piston 4' and the working piston 2' respectively, with a certain amount of play, so that there is unhindered movement of these pistons relative to one another in the axial direction. Since, on the other hand, the recesses 31, 32 and the connection 30, or the arbor which is provided to perform this function, all have a horizontal square cross-section, it is only possible for the two pistons to rotate together in the same direction despite there freedom of movement in the axial direction.

For the coupling means between the linear movement and the rotary movement which is to be produced, the displacement piston 4' is furnished with a cosine-shaped insert 33 made of magnetizable material, for example soft-iron, whereas the working piston 2' is furnished with a corresponding insert 34 which is sine-shaped, that is to say, it is phase displaced through an angle of 90° in relation to the insert 33. Magnets 35, 36 are attached to the wall of the engine housing and these interact with the inserts 33 and 34 respectively so that, during a longitudinal movement parallel to the axis 29, on the basis of the magnetic force components which have been described in connection with FIG. 2, the piston 2' and the piston 4' have a continuous rotary movement, in the direction shown by the arrow 28, imposed upon them. This rotary movement can be exploited by way of a magnetic coupling device which, in the example of embodiment depicted, is formed by the magnets 37, 38. It is possible to use the drive shaft 39, which is connected to the magnet arrangement 37, for driving aggregrates of secondary equipment.

Figure 4:
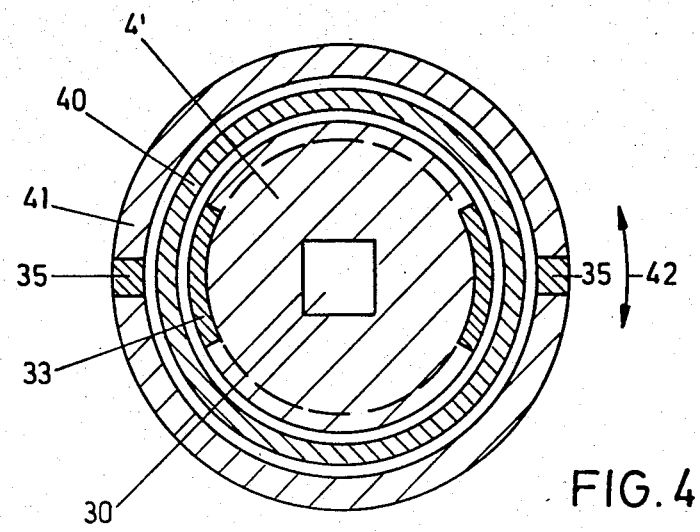

By referring to FIG. 4, it may be seen that the external magnets 35 (or 36, as the case may be) are mounted on an adjusting ring 41 which, as indicated by the double-headed arrow 42, allows for the adjustment of the angle position of the magnets 35 and 36 in relation to the housing 40, thus making possible the adjustment of the phase angle $\phi$ between the working piston 2' and the displacement piston 4'.

Figure 5:
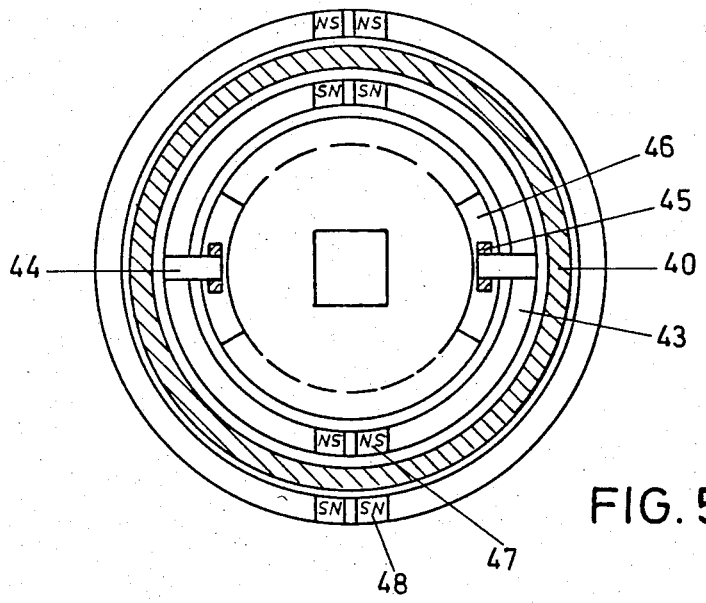

There is a form of embodiment illustrated in FIG. 5 in which an adjusting ring 43 is provided inside the housing 40. This adjusting ring 43 carries cam 44 which have rotating rollers 45 mounted on their inner ends. These rollers engage in a sine- or cosine-shaped annular groove 46 which is present on the displacement piston 4' and the working piston 2' respectively and thus serve as the coupling means for the production of a rotary movement derived from the translatory movement of the two pistons. The pairs of magnets 47 and 48 make possible the setting and/or the adjustment of the angle position of the adjusting ring 40 and thus also of the phase angle $\phi$ between the working piston and the displacement piston.

What is claimed is:

1. Heat engine, in particular a Stirling engine, comprising a displacement piston and a working piston which are coupled together in a housing sealed in a leak-proof manner against the outside so that they can oscillate in a linear direction, in which case the gas space between the displacement piston and the working piston is connected to the gas space between the displacement piston and the housing by way of a heater, a cooler and a regenerator arrangement to which an external source of heat may be connected, wherein one magnetic or magnetizable coupling device located within the housing is connected at least with the working piston and there is also a corresponding magnetic or magnetizable coupling device outside the housing which is movably mounted to coincide with the piston travel.

2. The heat engine according to claim 1, wherein the coupling device within the housing comprises a soft-iron ring and the coupling device outside the housing is formed from at least one magnet.

3. The heat engine according to claim 2, wherein the coupling device within the housing possesses annular grooves open towards the outside, and the coupling device outside the housing possesses annular grooves open towards the inside.

4. The heat engine according to claim 2, wherein the coupling device located outside the housing comprises an electromagnet which may be connected to a source of alternating current.

5. The heat engine according to claim 1, wherein not only the working piston but also the displacement piston is provided with a coupling device within the housing whereas the corresponding coupling devices outside the housing are connected together by way of a device which determines their mutual phase relation.

6. The heat engine according to claim 5, wherein the device for determining the phase relation is a mechanical drive, in particular a crankshaft drive.

7. The heat engine according to claim 1, wherein there is a transmission device engaging with at least one piston for the transmission of a rotary movement around their longitudinal axis of the pistons which is derived from the inherently linear movement of the pistons.

8. The heat engine according to claim 7, wherein there is a non-rotatable but axially movable connection between the pistons.

9. The heat engine according to claim 7, wherein the transmission device consists of a mechanical or magnetic first coupling means located on the wall of the housing and a corresponding second coupling means connected to the piston(s), in which case the first and/or the second coupling means has/have a sine-shaped or cosine-shaped configuration.

10. The heat engine according to claim 7, wherein the displacement piston has coupling means with a sine-shaped configuration and the working piston in relation thereto has coupling means with a cosine-shaped configuration.

11. The heat engine according to claim 7, wherein the angle relation of the first and/or the second coupling means is adjustable.

12. The heat engine according to claim 7, wherein the sine-shaped and the cosine-shaped coupling means are formed by a groove and the associated coupling means are formed by roller cams which engage in the said grooves.

13. The heat engine according to claim 7, wherein the sine-shaped and the cosine-shaped coupling means are formed by a magnetic or magnetizable material which follows a sine-shaped or a cosine-shaped pathway around a piston or around the wall of the housing.

* * * * *